US005160209A

United States Patent [19]

Schuessler

[11] Patent Number: 5,160,209

[45] Date of Patent: Nov. 3, 1992

[54] FASTENER ASSEMBLY FOR CONCEALABLY FASTENING A PAPER RETAINING MECHANISM TO A BINDER

[76] Inventor: Robert F. Schuessler, 2412 Inverness Cliffs, Birmingham, Ala. 35242

[21] Appl. No.: 569,659

[22] Filed: Aug. 20, 1990

[51] Int. Cl.[5] ..... B42F 13/00

[52] U.S. Cl. ..... 402/75; 402/27; 402/28; 403/283; 24/703.6; 29/13; 29/237.5; 29/513; 29/432; 411/468

[58] Field of Search ..... 29/13, 237.5, 432, 243.5, 29/509, 513; 24/703.6; 411/468, 467, 466, 503, 502; 403/283; 402/27, 28, 75

[56] References Cited

U.S. PATENT DOCUMENTS

| | | | |
|---|---|---|---|
| 991,393 | 5/1911 | Thompson | 402/28 |
| 1,051,527 | 1/1913 | Thompson | 402/27 |
| 1,771,104 | 7/1930 | Watson | 402/37 |
| 1,943,465 | 3/1931 | Watson | 402/75 |
| 2,282,624 | 5/1942 | Upson et al. | 411/466 |
| 2.751,139 | 6/1956 | Young | 29/432 |
| 2,805,880 | 9/1957 | Brozek et al. | 29/513 |
| 2,857,665 | 10/1958 | Cohen | 29/513 |
| 2,888,934 | 6/1959 | Segal | 402/75 |
| 3,197,729 | 7/1965 | Sarazen | 29/432 |
| 3,302,221 | 2/1967 | Zysman | 29/513 |
| 4,295,747 | 10/1981 | Errichiello | 402/75 |
| 4,697,945 | 10/1987 | Geiger | 402/75 |
| 4,722,628 | 2/1988 | Rager | 402/75 |
| 4,935,998 | 6/1990 | Frazier et al. | 411/466 |

*Primary Examiner*—P. W. Echols
*Assistant Examiner*—David P. Bryant
*Attorney, Agent, or Firm*—John W. Harbst

[57] ABSTRACT

A fastener for fastening a paper retaining binder mechanism to an inner surface of a binder while remaining entirely concealed from an outer surface of the binder. The fastener includes an anchor plate and a post. The anchor plate defines first and second major surfaces. The first major surface is in confronting relation fastened to an inner surface of the binder. The post extends directly away from the second major surface of the anchor plate and serves to secure the binder mechanism to the inner surface of the binder. Another aspect of the present invention relates to a method for fastening an apertured paper retaining binder mechanism to the binder in a manner concealing the fasteners from an outer surface of the binder.

10 Claims, 3 Drawing Sheets

FASTENER ASSEMBLY FOR CONCEALABLY FASTENING A PAPER RETAINING MECHANISM TO A BINDER

FIELD OF THE INVENTION

This invention generally relates to paper retaining binders or the like and, more particularly, to a method and apparatus for concealably fastening a paper retaining mechanism to a binder.

BACKGROUND OF THE INVENTION

Conventional covered binders for releasably securing and protecting sheets of paper or the like therein are well known. Such binders are provided in a variety of sizes and typically have a covering formed from two sheets or plies in overlying relationship. The covering is bent or folded along parallel lines to form a spine portion with two cover portions flexibly secured to opposite edges of the spine portion. Reinforcement sheets, usually comprised of flat sheets of cardboard or the like, are provided in the cover portions between the plies. A cardboard backplate is typically inserted between the plies in the spine portion to add strength, rigidity and form to the binder.

To promote the retention of paper therein, most binders include some form of paper retaining apparatus or binder mechanism. One popular binder mechanism comprises an elongated ring support plate having a series of snap-rings supported along the length thereof at selected positions. Such snap-rings pass through holes provided along one edge of the paper or sheet material adapted to be retained within the binder. Such a binder mechanism can be purchased in a variety of sizes and is typically secured along the spine portion of the binder.

To facilitate attachment of the binder mechanism to the binder, the ring support plate defines a series of holes spaced between the rings. Relatively inexpensive binders utilize rivet-like fasteners which are driven through the spine portion and through the holes in the ring support plate to secure the binder mechanism to the binder. During assembly, the free end of each rivet is peened into contact with the ring support plate thereby securing the paper retaining binder mechanism to the binder.

Albeit economical from a manufacturer's viewpoint to use a rivet to assemble the paper retaining binder mechanism to the binder, such an assembly process leaves at least a head portion of the rivet exposed to an outer surface of the binder cover. The exposure of the rivet presents a number of drawbacks including an unaesthetic and unattractive appearance for the binder and thereby reducing its customer appeal.

Manufacturers have been known, therefore, to provide an outer covering which extends along the spine portion to hide the head portions of the rivets. As will be appreciated, the addition of an outer covering material adds both material and manufacturing costs to the binder. Moreover, adding a cover to hide the rivet heads detracts from automation of the binder manufacturing process and is labor intensive.

Because customers appear willing to spend more for binders without exposed rivet head portions, other types of binders with paper retaining mechanisms have been proposed. One proposal involves a one-piece molded binder covering having a spine with cover panels integrally molded with and hingedly connected to the spine portion of the binder covering. A plurality of tubular posts on which the paper retaining or binder mechanism is mounted are molded integrally with the spine portion of the binder. A series of drive or clinch rivets are pressed into the tubular post to secure the binder mechanism to the binder.

As mentioned above, binders are usually provided in a variety of sizes including 1 inch, 1.50 inch, 2 inch, and 3 inch sizes. Of course, different size binders necessarily have different size binder mechanisms including appropriately sized snap-rings. As will be appreciated, the spine portion on the binder is sized to accommodate and is proportional to the particular snap-ring size of the binder. Accordingly, each one-piece molded binder covering which is different in size requires a separate mold or die set to produce that particular size binder. The use of different die sets in fabricating or molding different size binder encumbers automation of the binder manufacturing process and adds substantial cost to each binder.

Another proposed solution involves the insertion of an elongated hollow rectangular plastic backplate in the spine portion of the binder between the plastic plies. The ring hardware is secured to the backplate by metal rivets the free end of which depend through the ring hardware. The backplate is provided with preformed holes which accommodate the rivets. Ultimately, the metal rivets are sonically welded to the backplate. As will be appreciated, aligning the rivets with the preformed holes in a backplate hidden beneath a cover is labor intensive and adds to the cost of the binder.

Benefits provided by these proposals are offset by their additional cost, manufacturing problems, and added size inherent with such designs. Thus, there remains a need and desire for an economical method and apparatus for fastening a paper retaining mechanism to a binder while maintaining a fastener concealed from an outer surface of the binder.

SUMMARY OF THE INVENTION

In view of the above, and in accordance with the present invention, there is provided an improved fastener which, when used in combination with binders or the like, fastens a paper retaining binder mechanism to the binder while remaining entirely concealed from an outer surface of the binder. Another aspect of the present invention relates to a method for fastening an apertured paper retaining binder mechanism to a binder in a manner concealing the fasteners from an outer surface of the binder.

In the illustrated embodiment, the binder to which a paper retaining mechanism is to be fastened includes inner and outer surfaces. In a most preferred form, the binder includes a spine portion with cover portions flexibly secured to opposite edges of the spine portion. To add rigidity, strength, and form to the binder, the spine portion thereof has an inexpensive cardboard or chipboard backplate entrapped between the inner and outer surfaces thereof.

In the illustrated embodiment, the paper retaining mechanism to be fastened to the binder is in the form of metal ring hardware. The metal ring hardware or binder mechanism includes an apertured ring support plate having a series of snap rings supported along the length thereof at selected positions. The apertures in the ring support plate are defined by one or more standoff sleeves or flared eyelets fixedly secured within the ring support plate.

In a first embodiment of the present invention, the fastener includes an anchor plate and a post. The anchor plate has a series of attaching devices extending in a first direction and away from a first major surface of the anchor plate. The post directly extends from a second major surface of the anchor plate in a direction opposed to the first direction. The post is configured to secure a device passing thereover against movement relative to the anchor plate.

The anchor plate has a generally rectangular configuration ranging between about 0.500 inches to about 1.500 inches in a first planar direction and about 1.00 inches to about 2.25 inches in a second planar direction. In a most preferred form, the anchor plate measures about 0.875 inches in one planar direction and about 1.250 inches in a second planar direction.

The attaching devices on the anchor plate comprise a series of prongs which are integrally formed from the anchor plate. When the fastener is pressed against the inner surface of the binder during assembly, the attaching prongs are configured to pierce the inner ply of the binder and embed entirely within the backplate in the spine portion of the binder to secure the fastener thereto. Because it is secured to the inner surface of the binder, the fastener including the attaching prongs is concealed from the outer surface of the binder.

In the first embodiment, the fastener post is comprised of at least two bendable tabs which are integrally formed from the anchor plate during a stamping operation. Each tab preferably has a generally semi-circular configuration and is bendable into confronting relation with the other tab to define a hollow center post. Moreover, the tabs are formed from a deformable material which facilitates peening a free end thereof.

Like the first embodiment, the second embodiment of the fastener includes an anchor plate and a post. The anchor plate of this fastener is substantially similar to that described above with the exception that a central region of the anchor plate is raised and apertured. The post comprises a rivet-like member having a head portion and a body portion.

When this fastener is secured to a binder, the head portion of the post is entrapped between the anchor plate and an inner surface on the binder. As such, the entire fastener is concealed from the outer surface of the binder. A body portion of the post passes through the aperture defined by the anchor plate and passes through an aperture defined by the ring anchor plate of the paper retaining binder mechanism. As with the first embodiment, the post of this fastener extends directly away from the anchor plate for distance greater than the cross-sectional configuration of the ring anchor plate on the paper retaining binder mechanism, and the upper end thereof is outwardly flared as by peening to secure the paper retaining binder mechanism to the binder.

A third embodiment of the fastener also includes an anchor plate and a post. The anchor plate of this fastener is substantially similar to that described with respect to the first embodiment. The post of this fastener is secured against movement relative to and projects directly from a major surface on the anchor plate. The post is configured to slidably receive and hold a lower end or portion of the flared eyelet on the ring support plate in a manner securing the ring hardware or binder mechanism to the binder. Because the fastener is secured to an inner surface of the binder, it is concealed from the outer surface on the binder.

In a fourth embodiment of the invention, the fastener includes an anchor plate and a post. The purpose of the anchor plate is to secure the fastener to the inner surface of the binder while remaining concealed from an outer surface thereof. The post extends away from the anchor plate and away from the inner surface of the binder. The post of this fastener passes through and is fastened to an apertured locking member provided on the ring binder in a manner securing the binder mechanism to the inner surface of the binder while maintaining the fastener concealed from an outer surface of the binder.

The present invention also relates to a method for securing an apertured paper retaining mechanism to an inner surface of a binder having inner and outer surfaces. The method comprises the steps of: arranging the binder such that the inner surface thereof is supported; applying a fastener to the inner surface of the binder, wherein the fastener comprises an anchor plate and a post secured against movement relative to the anchor plate, and wherein the anchor plate has one major surface arranged in a secured and confronting relation to the inner surface of the binder, and the post extends directly away from the other major surface of the anchor plate; and, securing the paper retaining mechanism to the binder as by allowing the post on the fastener to engage with the apertured paper retaining mechanism while remaining concealed from an outer planar surface of the binder.

The step of applying a fastener to the inner surface of the binder further comprises the step of: piercing the inner surface of the binder with a series of attaching prongs depending from and until one major surface on the anchor plate lies in substantially confronting relation with the inner surface of the binder. Moreover, the step of securing the paper retaining mechanism to the binder comprises the further step of: placing the apertured paper retaining mechanism in vertically aligned relation with the post on the fastener so as to allow a free end of the post to pass upwardly therethrough.

In one form of the invention, the step of securing the paper retaining mechanism to the binder comprises the further step of peening a free end of the post into a generally flared configuration to secure the paper retaining mechanism to the binder. Depending on the fastener embodiment, the method for securing the apertured paper retaining mechanism to the binder comprises the further step of: bending a pair of tabs into confronting relation relative to each other to define the post on the fastener.

The present invention offers a simple and relatively inexpensive fastener for securing a paper retaining binder mechanism to an inner surface of a binder with no exposed portion of the fastener on the outer surface of the binder. Notably, one size of fastener can be used to fasten various size paper retaining binder mechanisms to the inner surface of the binder thereby minimizing binder manufacturing costs. Moreover, the ease of attaching the fastener to an inner surface of the binder coupled with its simplistic design facilitate automated manufacturing of binders with paper retaining mechanisms secured thereto. Since no portion of the fastener is exposed to an outer surface of the binder, there is no need for costly covers which hide the fastener and add to the manufacturing cost of the binder. As a result of the present construction, a binder without exposed rivets can be fabricated at prices which are closely competitive with binders having exposed rivets and are less expensive than binders having ancillary covers used to hide or coverup rivet heads.

Numerous other features and advantages of the present invention will become readily apparent from the following detailed description, the accompanying drawings, and the appended claims.

DETAILED DESCRIPTION OF THE PRESENT INVENTION

Figures 1, 2, 3, 4, 5:
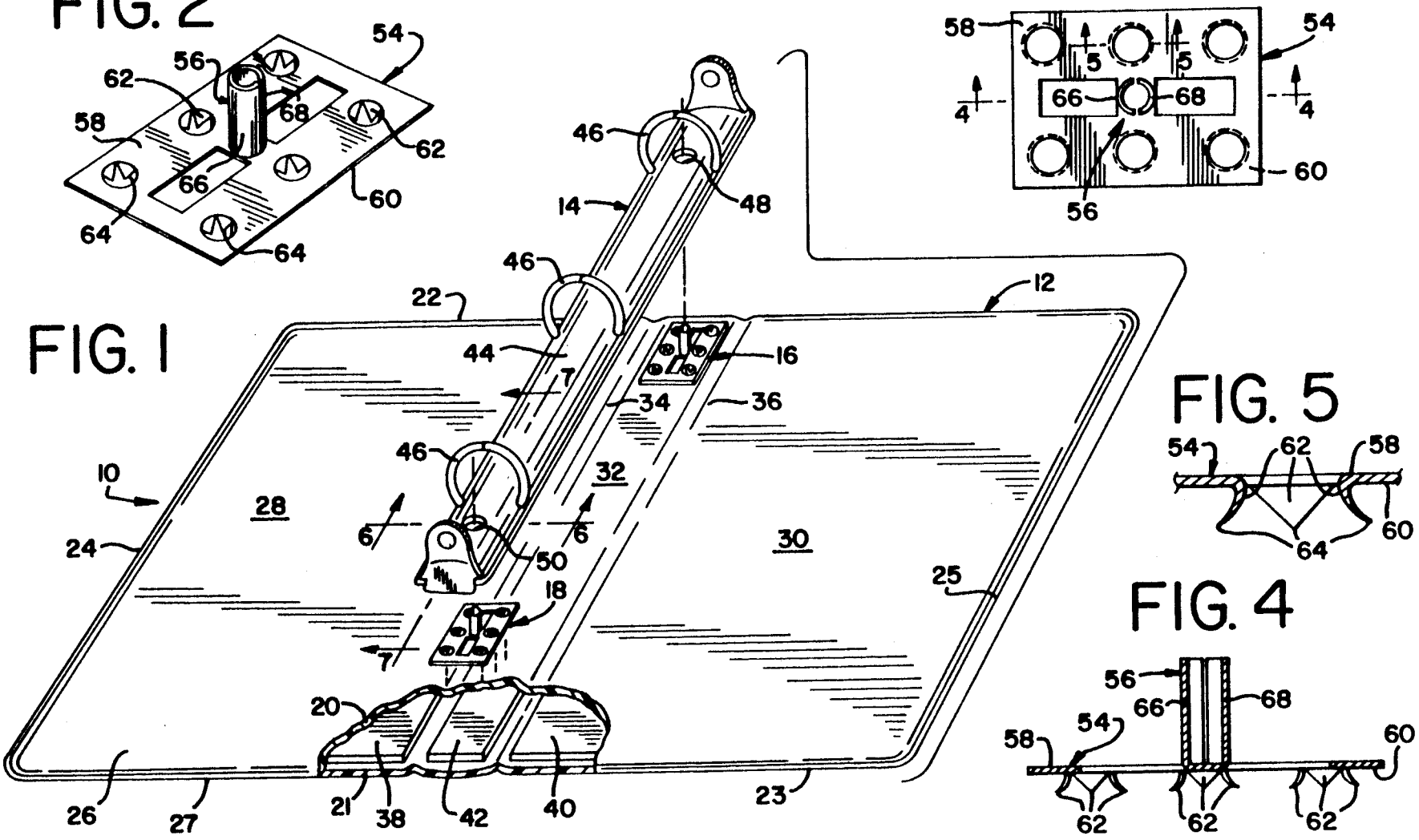
FIG. 1 is a perspective view, partially broken away, of a binder with paper retaining ring hardware which is fastened to an inner surface of the binder with fasteners incorporating principles of the present invention.
FIG. 2 is a perspective view of a first embodiment of a fastener used to fasten paper retaining hardware to a binder.
FIG. 3 is a plan view of the fastener illustrated in FIG. 2.
FIG. 4 is a longitudinal sectional view taken along line 4—4 of FIG. 3.
FIG. 5 is a longitudinal sectional view taken along line 5—5 of FIG. 3.

While the present invention is susceptible of embodiment in various forms, there is shown in the drawings and will hereinafter be described, several different embodiments of the invention with the understanding that the present disclosure is to be considered as exemplifications of the invention which are not intended to limit the invention to the specific embodiments illustrated.

Referring now to the drawings, wherein like reference numerals indicate like parts throughout the several views, FIG. 1 illustrates a binder 10 for releasably holding sheet material, such as paper, cards, brochures, and the like. The binder 10 includes a cover 12, paper retaining hardware 14, and fasteners 16 and 18 for fastening the ring hardware 14 to the cover 12. It should be understood, that the illustrations reflecting the cover 12 and ring hardware 14 are one example of how fasteners 16 and 18 can be utilized. Of course, fasteners 16 and 18 are equally applicable to other binders and other paper retaining hardware mechanisms.

As shown in FIG. 1, cover 12 is formed from two material plies or sheets 20 and 21 which are secured together along opposite lateral edges 22 and 23 and along opposite side edges 24 and 25 to define inner and outer surfaces 26 and 27, respectively, for the binder 10. The material plies 20 and 21 can be made from a myriad of materials such as cloth, canvas, or synthetic materials such as plastic or vinyl. When plastic or vinyl is used, the edges of the plies may be electronically sealed to each other.

In the illustrated embodiment, cover 12 includes a front cover portion 28, a rear cover portion 30, and a spine portion 32 therebetween. Spine portion 32 interconnects the front and rear cover portions 28 and 30, respectively, at junction or hinge lines 34 and 36. Cardboard or chipboard reinforcement sheets 38 and 40 are arranged between the plies 20 and 21 to reinforce the front and rear cover portions 28 and 30 of the binder, respectively. A backplate 42, preferably formed from cardboard or chipboard, or like materials, is also located between plies 20 and 21 intermediate the hinge lines 34 and 36. As shown, the backplate 42 preferably has substantially the same thickness as the reinforcement sheets 38 and 40 and preferably runs the length of the spine portion 32 to add strength, rigidity, and form to the binder 10.

The paper retaining mechanism or hardware 14 is illustrated as a snap-ring binder mechanism which is supplied in various sizes to suit the customer's needs and is of conventional construction. One example of such a binder mechanism is sold as a three-ring metal binder by U.S. Ring of New Bedford, Mass., and has various capacities.

The paper retaining mechanism shown is a three-ring binder mechanism which is preferably attached along the spine portion 32 of the binder 10 but it should be appreciated that it may likewise be attached to either the front or rear cover portions 28, 30 of the binder. Binder mechanism 14 typically includes a ring support plate 44 with three snap-rings 46 positioned therealong complementary to the holes in the sheet material to be releasably secured within the binder. Of course, any number, size or configuration of the rings 46 that is complementary to the sheet material to be releasably secured within the binder is also considered to be part of this invention.

Figure 7:
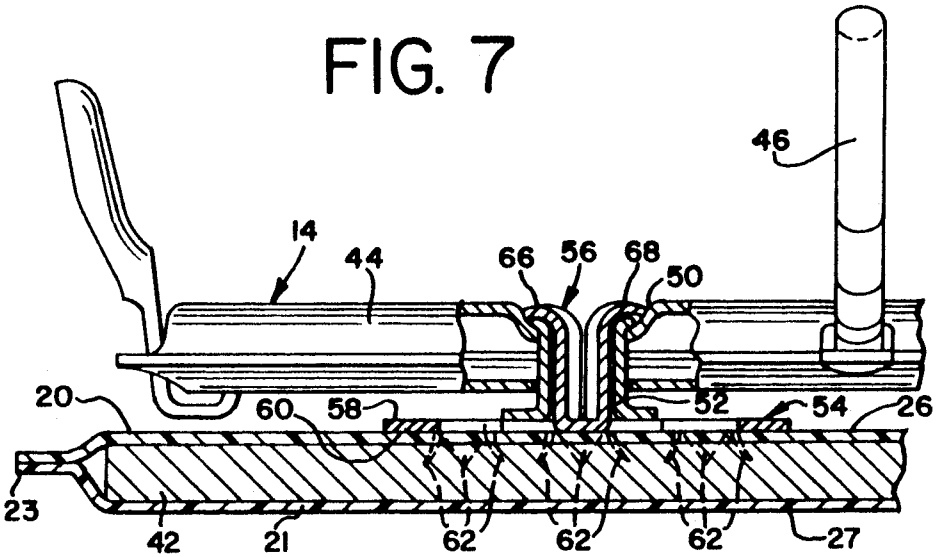
FIG. 7 is an enlarged sectional view taken along line 7—7 of FIG. 1.
Figure 6:
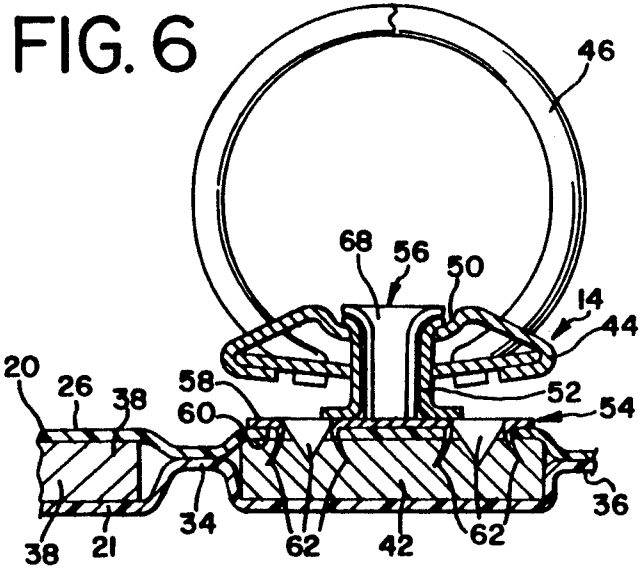
FIG. 6 is an enlarged sectional view taken along line 6—6 of FIG. 1.

As illustrated, the ring support plate 44 defines two apertures 48 and 50 at opposite ends of the support plate 44 to facilitate attachment of the mechanism 14 to the inner surface of the binder 10 Each of the apertures are defined by conventional standoff sleeves or eyelets 52 (FIGS. 6 and 7). Each sleeve or eyelet 52 is provided with flared ends.

The fasteners 16 and 18 are substantially similar in construction, and, thus, only a description of fastener 18 will be provided with the understanding that fastener 16 is similarly constructed. As shown, each fastener is secured toward a lateral edge and to the inner surface 26 of the binder. Each fastener is preferably formed as by stamping it from a sheet of steel having a thickness ranging between about 0.015 inches and about 0.050 inches. In a most preferred form, the thickness of the fastener is about 0.020 inches.

Turning to FIGS. 2 and 3, each fastener includes an anchor plate 54 and a post 56. In this first embodiment, the anchor plate 54 and post 56 are formed as an integral assembly to facilitate handling of the fasteners.

The anchor plate 54 of each fastener of the first embodiment preferably has a generally rectangular configuration and defines first and second major surfaces 58 and 60. The rectangular configuration of the anchor plate 54 ranges between about 0.500 inches and about 1.500 inches in a first planar direction, and about 1.00 inches to about 2.250 inches in a second planar direction. In a most preferred form, the anchor plate 54 measures about 0.875 inches in a first planar direction and about 1.250 inches in a second planar direction. Notably, the same size fastener is used to fasten any size paper retaining mechanism to the inner surface 26 of the binder.

In a preferred form, and as illustrated in FIGS. 2, 4 and 5, each anchor plate 54 furthermore includes a series of attaching prongs 62 for securing the fastener to the inner surface of the binder. As shown, the attaching prongs or pointed projections 62 are integrally formed with anchor plate 54. Preferably the prongs 62 are concurrently formed with stamping of the fastener from the sheet steel. As illustrated in FIGS. 2, 4 and 5, the attaching prongs 62 bend downwardly and extend away from the major surface 60 of anchor plate 54. Preferably, each prong has arcuate configuration and depends about 0.100 inches below the major surface 60 of attaching plate 54. As shown, each prong 62 terminates in a sharpened tip portion 64 to facilitate piercing the inner ply 20 of the cover 12 when the fastener is secured to the inner surface of the binder. Notably, the arcuate configuration of each prong 62 facilitates the attachment of the fastener to the binder by having each prong embed entirely within the backplate 42 and such that no portion of the prong extends to the outer surface of the binder.

As illustrated in FIGS. 2, 3 and 4, in this first embodiment, post 56 of each fastener is comprised of bendable tabs 66 and 68. As with the attaching prongs 62, the bendable tabs 66 and 68 are preferably fabricated in the same stamping operation as is the fastener. As will be appreciated, when originally formed, the tabs 66 and 68 lie in generally the same reference plane with the anchor plate 54.

In the illustrated embodiment, each of the tabs 66 and 68 has a generally semi-circular configuration. As will be discussed hereinafter, the tabs 66 and 68 are subsequently turned or bent into confronting relation with each other. As such, the tabs 66 and 68 combine to define a hollow center post having a diameter equal to or less than the inside diameter of the flared eyelet 52 (FIG. 6) on the ring support plate 44 of the binder mechanism 14.

Turning to FIGS. 6 and 7, the upturned or bent tabs 66 and 68 extend directly away from the major surface 58 of the anchor plate 54 for a distance somewhat greater than the cross-sectional configuration of the ring support plate 44 of the binder mechanism 14. Notably, the hollow center of the post 56 and the material from which the tabs 66 and 68 are fabricated facilitate peening of the free ends of the post 56 to secure the binder ring hardware 14 to the inner surface of the binder 10.

Figure 9:
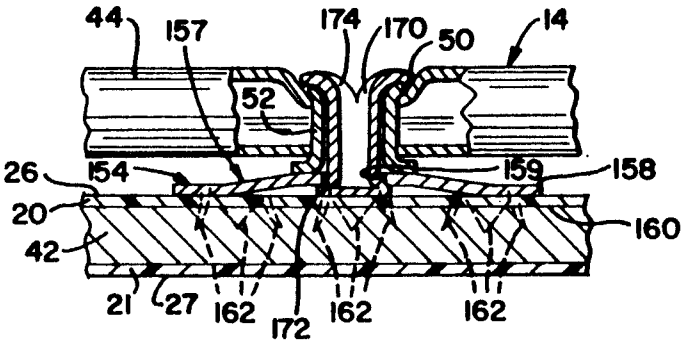
FIG. 9 is a longitudinal sectional view similar to FIG. 7 showing the second embodiment of the fastener as fastened to a binder.
Figure 8:
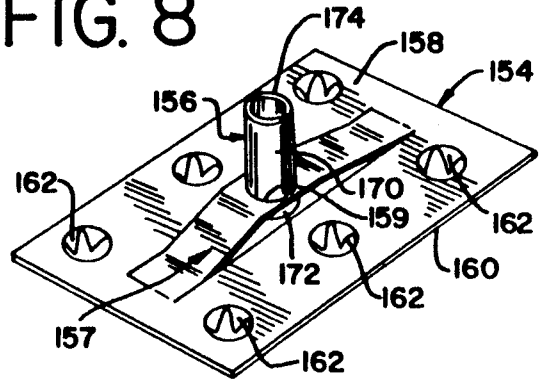
FIG. 8 is a perspective view of a second embodiment of a fastener used to fasten paper retaining hardware to a binder.

FIGS. 8 and 9 illustrate a second embodiment of a fastener. Some of the component parts of the fastener illustrated in FIGS. 8 and 9 are substantially similar to the component parts of the fastener discussed above. Therefore, those component parts of the fastener in the second embodiment having similarities to the component parts of the first embodiment of the fastener have similar reference numerals in the one-hundred series.

The fastener schematically illustrated in FIGS. 8 and 9 includes an anchor plate 154 and a post 156. The anchor plate 154 is substantially similar in size and configuration to anchor plate 54 and includes major surfaces 158 and 160. As with anchor plate 54, anchor plate 154 includes a series of attaching prongs 162 for securing the fastener to the inner surface of the binder. The attaching prongs 162 are formed in a manner and are substantially similar to the attaching prongs 62 discussed in detail above and, therefore, no further discussion need be provided therefore.

A salient feature concerning the second embodiment of the fastener involves forming the anchor plate 154 with a raised or central portion or section 157 having a cross-sectional thickness which is generally equal to the cross-sectional thickness of the remainder of the anchor plate 154. The central portion 157 of anchor plate 154 defines an aperture 159 for accommodating and holding a portion of post 156 relative to the anchor plate 154.

In this second embodiment, a rivet-like steel member 170 defines the post 156 of the fastener. The rivet like member 170 includes a head portion 172 and a body portion 174. As shown in FIG. 9, the head portion 172 of member 170 is entrapped between the underside of central portion 157 of anchor plate 154 and an inner surface 26 on the binder. As such, no portion of the fastener is exposed to an outer surface of the binder. The body portion 174 of post 156 passes through the aperture 159 in the anchor plate 154 and extends directly away from the major surface 158. The body portion 174 of post 156 preferably has a cylindrical configuration having a hollow or tubular free end.

The body portion 174 of post 156 has a diameter equal to or slightly less than the inside diameter of the flared eyelet 52 on the ring support plate 44. Moreover, the body portion 174 of post 156 extends away from the anchor plate 154 for a distance somewhat greater than the cross-sectional configuration of the ring support plate 44 of the binder mechanism 14. Notably, the hollow free end of body portion 174 and the material from which it is formed facilitates peening of the free end of the post 156 to secure the ring binder hardware 14 to the inner surface of binder 10.

Figure 11:
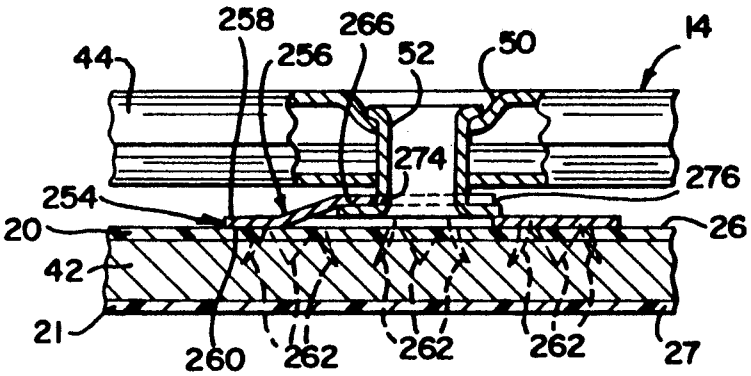
FIG. 11 is a longitudinal sectional view similar to FIG. 7 showing the third embodiment of the fastener as fastened to a binder.
Figure 10:
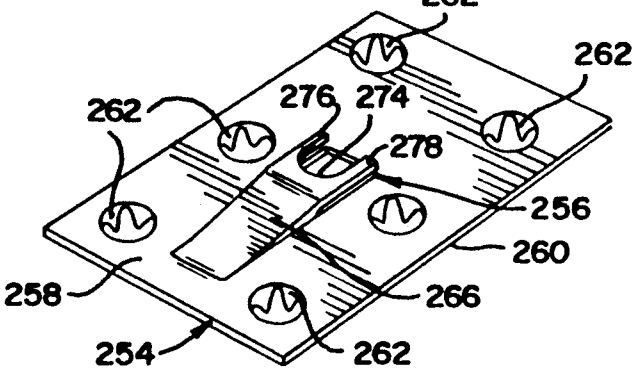
FIG. 10 is a perspective view of a third embodiment of a fastener used to fasten paper retaining hardware to a binder.

FIGS. 10 and 11 illustrate a third embodiment of a fastener. Some of the component parts of the fastener illustrated in FIGS. 10 and 11 are substantially similar to the component parts of the fastener of the first embodiment discussed in detail above. Therefore, those component parts of the fastener of the third embodiment having similarities to the component parts of the fastener of the first embodiment have similar reference numerals in the two-hundred series.

The fastener schematically illustrated in FIGS. 10 and 11 includes an anchor plate 254 and a post 256. The anchor plate 254 is substantially similar in size and configuration to anchor plate 54 and includes major surfaces 258 and 260. Anchor plate 254 includes a series of attaching prongs 262 for securing the fastener to the inner surface 26 of the binder. The attaching prongs 262 are substantially similar to the attaching prongs 62 discussed above and therefore no further discussion need be provided therefor.

A salient feature of the fastener of the third embodiment concerns the post 256. As illustrated, post 256 is formed as an upstruck and slotted tab 266 which is spaced from and joined to anchor plate 254. In this embodiment, at least a portion of the tab 266 extends above and generally parallel to the anchor plate 254. The undersurface of that portion of the tab 266 extending above and generally parallel to the anchor plate is located above the upper surface 258 of anchor plate by a distance slightly less than the wall thickness of the eyelet 52. The tab 266 defines a generally U-shaped slot 274 having generally parallel sidewalls 276 and 278. The distance between the sidewalls 276 and 278 is substantially equal to the diameter of the eyelet 52 on the ring support plate 44 and less than the outside diameter of the flared ends of that eyelet.

Figure 13:
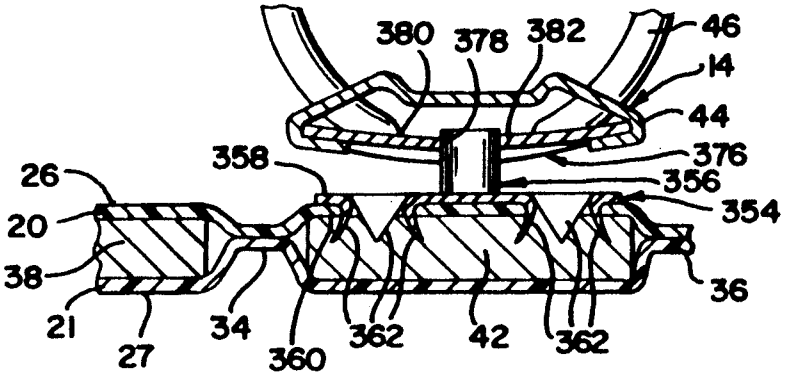
FIG. 13 is a perspective view of a locking member which forms part of the paper retaining ring hardware and which combines with a fastener as shown in FIG. 12 to fasten the ring hardware to an inner surface of a binder.
Figure 12:
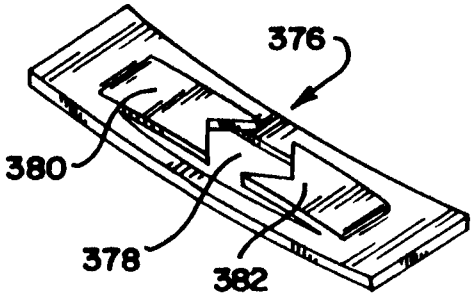
FIG. 12 is a cross-sectional view similar to FIG. 6 showing a fourth embodiment of a fastener used to fasten paper retaining hardware to a binder.

FIGS. 12 and 13 illustrate another form of fastener for securing a ring binder mechanism to an inner surface of a binder. Some of the component parts of the fastener illustrated in FIGS. 12 are substantially similar to the fastener illustrated in the first embodiment discussed in detail above. Therefore, those component parts of the fastener in the fourth embodiment having similarities to the component parts of the fastener of the first embodiment have similar reference numerals in the three-hundred series.

The fastener schematically illustrated in FIG. 12 includes an anchor plate 354 and a post 356. The anchor plate 354 is substantially similar in size and configuration to anchor plate 54 and includes major surfaces 358 and 360. As with anchor plate 54, anchor plate 354 includes a series of attaching prongs 362 for securing the fastener to the inner surface of the binder. Preferably, the attaching prongs 362 are formed in a manner and are substantially similar to that discussed above and therefore no further discussion need be provided.

The post 356 of this fastener may be integrally formed with the anchor plate 354 or could be a separate rivet-like member such as described in detail above with reference to the second embodiment of the fastener. With either type of construction, it should be appreciated that the distance the post 356 projects away from the major surface 358 of plate 354 is somewhat less than the cross-sectional area of the ring support plate 44 of the ring binder mechanism 14.

To facilitate attachment of the ring binder mechanism 14 to the fastener, a locking member 376 is fixedly attached to and carried beneath the ring support plate 44 of binder mechanism 14. In a preferred form, and as illustrated in FIG. 13, the locking member 376 has a slightly bowed configuration and defines a centrally arranged aperture 378. The aperture 378 is defined between terminal ends of a pair of locking fingers 380 and 382. The locking fingers 380 and 382 are integrally formed from locking member 376. As is conventional, the aperture 378 is sized to accommodate the passage of post 356 therethrough and prevent its removal in the opposite direction thereby securing the ring hardware mechanism 14 to the inner surface of the binder.

The method by which a fastener embodying principles of the present invention fastens or secures the ring hardware 14 having a ring support plate 44 to an inner surface 26 of a binder is believed to be understood from the above but will be briefly summarized at this point. Notably, the fastener of the present invention promotes preassembly of the cover 12 with the cardboard reinforcement sheets 38 and 40 sealed within the cover portions 28 and 30, respectively, and with the backplate 42 extending along the length of and, if so desired, sealed within spine portion 42 of the binder.

For purposes of this description, the ring hardware 14 will be described as being fastened to the spine portion 32 of the binder, but it should be appreciated that, with slight modifications in the fabrication methods, it would likewise be possible to fasten the ring hardware to either cover portion of the binder without detracting from the spirit and scope of the present invention.

According to the present invention, a completed cover 12 is arranged such that the inner surface 26 is supported. Preferably, cover 12 is arranged such that the inner surface 26 is facing upwardly and is supported against vertical movement.

Thereafter, first and second fasteners 16 and 18, as illustrated in the first embodiment of the invention, are attached to the binder. The preferred method of attaching each fastener to the inner surface of the binder comprises a step of piercing the inner surface 26 of the binder with attaching prongs 62 which are integrally formed with and depend from major surface 60 on the anchor plate 54 defined by the fastener.

As illustrated in FIG. 6, and as should be appreciated, when vertical pressure is applied to either the fastener or binder cover, the attaching prongs 62 pierce the ply or inner layer 20 until the major surface 60 on the anchor plate 54 of the fastener lies in substantially confronting relation with the inner surface 26 of the binder. As shown, the attaching prongs 62 are configured to become fully embed within the backplate 42 and prevent relative movement between the fastener and the inner surface of the binder without exposing any portion of the fastener to an outer surface of the binder.

With respect to the first embodiment, and preferably concurrently with application of the fastener to the inner surface of the binder, the tabs 66 and 68 are bent into confronting relation so as to extend directly away from the second major surface 58 of the anchor plate and combine to define the hollow post 56. It should be appreciated, however, that, if so desired, the tabs 66 and 68 may be bent into confronting relation before or after the fastener is attached to the inner surface of the binder. Notably, the fasteners 16 and 18 are secured to the inner surface 26 of the binder such that the distance separating the upstruck posts 56 of the fasteners is equal to the distance separating the apertures 48 and 50 defined on the ring support plate 44 of the binder mechanism 14.

With each fastener secured to the binder, the paper retaining hardware is fastened to the binder as by aligning the apertures 48 and 50 in the ring support plate 44 and by allowing the post 56 on the fasteners to engage with the apertured ring support plate 44. Preferably, the post 56 of each fastener extends through the flared eyelet 52 provided on the ring hardware.

In this first embodiment, the post 56 extends away from the major surface 58 of the anchor plate 54 for a distance greater than the cross-sectional area of the ring support plate 44. The hollow configuration and the material from which each post 56 is formed facilitates peening a free end of the post into a generally flared configuration. As illustrated in FIGS. 6 and 7, peening the free end of each post 56 presses the free end of the post toward the eyelet 52 thereby eliminating any clearance between the post and the ring hardware so as to securely fasten the ring hardware to the inner surface 26 of the binder while maintaining the entire fastener concealed from the outer surface of the binder.

The fastener as illustrated in FIGS. 8 and 9 is substantially similar to that illustrated in FIGURES 2 through 5 with the exception that the anchor plate 154 and post 156 are separate elements. Before securing each fastener of the second embodiment to the binder, the rivet like member 170 is passed through the aperture 159 defined in the central portion 157 of the anchor plate 154.

After assemblage, each fastener is secured to an inner surface 26 of the binder as with the attaching prongs 162. When attached to the binder, and as illustrated in FIG. 9, the head portion 172 of the post 156 is entrapped between a lower surface on the central portion 157 of the anchor plate 154 and the inner surface 26 of the binder. The body portion 174 of post 156 extends directly away from major surface 158 of the anchor plate 154.

Thereafter, the ring hardware 14 is secured to the fastener as by aligning the apertures in the ring support plate 44 and allowing the post 156 on the fastener to engage with the ring hardware. As discussed above, the free ends of the body portion 174 are peened over to secure the ring hardware to the inner surface of the binder while maintaining the entire fastener concealed from the outer surface of the binder.

The fastener as illustrated in FIGS. 10 and 11 includes an anchor plate 254 and post 256. As shown, the anchor plate 254 fastens the fastener to the inner surface of the binder as by the attaching prongs 262.

The post 256 combines with the flared eyelet 52 on the binder mechanism 14 to secure the ring hardware to the binder. As illustrated, the eyelet slides or passes into the slot 274 provided on the upstruck tab 266 on the anchor plate 254 and is entrapped between sidewalls 276 and 278. As shown in FIG. 11, the free end of tab 266 provides a spring action which biases the eyelet 52 against the anchor plate 254 to securely hold or fasten the ring hardware to inner surface 26 of the binder.

Turning now to FIGS. 12 and 13, a fastener similar to either the first or second embodiment discussed above combines with the apertured locking member 376 to secure the ring binder hardware 14 to the binder. As illustrated in FIG. 12, the post portion 356 of the fastener extends away from the anchor plate 354 of the fastener for a shorter distance than that illustrated in the fastener of the first two embodiments.

In this embodiment, one or more apertured locking members 376 are secured along the length of the ring hardware. As will be appreciated, the apertured locking members 376 may be secured to the undersurface of the ring support plate 44 in areas aligned with or spaced from the eyelets 52.

After the aperture 378 in the locking member 376 is aligned with the post 356 on the fastener which is fastened to an inner surface of the binder, the post 356 passes through the aperture 378 defined by the locking member 376. As is conventional, the locking fingers 380 and 382 on the locking member 376 combine to act against the circumference of the post 356 of the fastener thereby securing the binder hardware to the binder while remaining entirely concealed from an outer surface of the binder.

It will be appreciated from the foregoing that the invention herein can take many forms other than the preferred form shown in the drawings and that the invention as herein claimed is not limited to the illustrated embodiments. For example, the post cf the fastener can be formed integrally with or separate from the anchor plate of the fastener. Moreover, the post of a fastener may extend through the ring support plate and its free end may be peened or may otherwise combine with the ring hardware to secure it to the inner surface of the binder. Notably, one size fastener can be used for almost any size of ring binder mechanism 14 to be fastened to the binder. A salient feature of the present invention being the ability to fasten the ring hardware to an inner surface of the binder with a fastener which remains entirely concealed from an opposite or outer surface of the binder. The ease of attaching or fastening the fastener to an inner surface of the binder coupled with its simplistic design facilitates automated manufacture of binders with suitable paper retaining mechanisms fastened thereto.

From the foregoing, it will be observed that numerous modifications and variations can be effected without departing from the true spirit and scope of the novel concept of the present invention. It will be appreciated that the present disclosure is intended to set forth exemplifications of the invention which are not intended to limit the invention to the specific embodiments illustrated. The disclosure is intended to cover by the appended claims all such modifications as fall within the scope of the claims.

What is claimed is:

1. A concealed fastener assembly for fastening apertured paper retaining means to an inner surface of a binder having inner and outer surfaces, said fastener assembly comprising:

a pair of fasteners attached to an inner surface of said binder such that said pair of fasteners are concealed from an outer surface of said binder, each fastener comprising a planar anchor plate having first and second major surfaces, one of said major surfaces being fastened to said inner surface of said binder such that no portion thereof is visible to an outer surface of said binder, and post means secured against movement relative to said anchor plate, said post means being formed from two generally semi-circular tabs connected to and bent generally perpendicularly to the anchor plate such that said tabs are in an adjoining relation with each other and extend in a direction normal to the major surfaces of said plate to provide said post means with an elongated hollow configuration extending directly away from said anchor plate and sized to extend lengthwise through a respective aperture in said paper retaining means to locate and fasten said paper retaining means to said binder while remaining concealed from the outer surface of said binder.

2. The fastener assembly according to claim 1 wherein each fastener further includes attaching means extending in a first direction from said first major surface of said anchor plate for fastening said anchor plate to an inner surface of said binder.

3. The fastener assembly according to claim 2 wherein said attaching means of each fastener comprises a series of depending prongs, with each prong being stamped from said anchor plate and having a sharpened tip portion.

4. The fastener assembly according to claim 1 wherein the anchor plate of each fastener has a generally rectangular configuration of about 0.875 inches in a first planar direction and about 1.250 inches in a second planar direction.

5. The fastener assembly according to claim 1 wherein a free end of the post means of a respective fastener passes through and combines with an apertured locking member carried by and which secures said paper retaining means to said binder.

6. A concealed fastener assembly for fastening apertured ring hardware to a ring binder, wherein the ring binder defines a spine portion and two cover portions flexibly secured to opposite edges of said spine portion, said spine portion of said binder having inner and outer generally planar surfaces with a backplate entrapped therebetween, said fastener assembly comprising:

a pair of fasteners respectively located toward opposite edges of said spine portion such that sad pair of fasteners are concealed from an outer surface of said binder, each fastener including an anchor plate having first and second major surfaces and attaching means depending from said first major surface which concealably attach a respective fastener to the inner surface of the spine portion of said binder such that neither said anchor plate nor said attaching means are visible to the outer surface of said binder, and post means secured against movement relative to and extending normal to the second major surface of a respective anchor plate and concealed from the outer surface of said binder, with each post means comprising two generally semi-circular tabs, each of which is connected to a respective anchor plate and bent in opposite directions into adjoining relation with each other to provide said post means with an upstruck elongated hollow tubular stem portion sized to extend lengthwise through a respective aperture in said ring hardware, with the free end of said post means being configured to flare outwardly to locate and fasten the ring hardware to the inner surface of the spine portion of said ring binder while remaining entirely concealed from the outer surface of said ring binder.

7. The fastener assembly according to claim 6 wherein said attaching means on each respective anchor plate comprises a series of deformable prongs which are stamped from and integrally formed with said anchor plate, with each prong being configured to embed within said backplate and deform horizontally in response to application of a vertical force directed thereagainst and such that no portion of said prong penetrates or is visible to an outer surface of said binder.

8. The fastener assembly according to claim 6 wherein each anchor plate has a generally rectangular configuration extending about 0.875 inches in a first planar direction and extending about 1.250 inches in a second planar direction.

9. A concealed fastener assembly for fastening paper retaining means to an inner surface of a ring binder having inner and outer surfaces, said fastener assembly comprising:

a pair of fasteners attached to an inner surface of said binder for fastening said paper retaining means thereto such that said pair of fasteners are wholly concealed from an outer surface of the binder, each fastener comprising an anchor plate defining first and second major surfaces, means for securing the anchor plate to the inner surface of said binder such that a majority of the first major surface contacts and is affixed to the inner surface of the binder to prevent shifting movement therebetween and such that no portion of said anchor plate or said securing means is visible to an outer surface of the binder, and post means extending generally normal to the second major surface and secured against movement relative to said anchor plate, said post means having a generally hollow configuration which is open at a distal end and is sized to extend lengthwise through a respective aperture in said paper retaining means, with the open end of said post means having a flared configuration to locate and fasten the paper retaining means and prevent movement thereof relative to an inner surface of the binder while remaining concealed from an outer surface of the binder.

10. The fastener assembly according to claim 9 wherein each post means of each fastener comprises a rivet-like fastener having an enlarged head portion entrapped between its respective anchor plate and the inner surface of said binder so as to remain concealed from an outer surface of said binder the elongated hollow stem portion connected to the head portion and extending generally normal to the second major surface of the respective anchor plate, said stem portion terminating in a free end which extends through said aperture defined by said ring hardware.

* * * * *

US005160209B1

REEXAMINATION CERTIFICATE (3991st)

United States Patent [19] [11] B1 5,160,209

Schuessler [45] Certificate Issued Feb. 8, 2000

[54] FASTENER ASSEMBLY FOR CONCEALABLY FASTENING A PAPER RETAINING MECHANISM TO A BINDER

[75] Inventor: Robert F. Schuessler, Birmingham, Ala.

[73] Assignee: World Wide Stationery Manufacturing Company Limited, Kwai Chung, The Hong Kong Special Administrative Region of the People's Republic of China

Reexamination Request:
No. 90/004,568, Feb. 28, 1997

Reexamination Certificate for:

| | |
|---|---|
| Patent No.: | **5,160,209** |
| Issued: | **Nov. 3, 1992** |
| Appl. No.: | **07/569,659** |
| Filed: | **Aug. 20, 1990** |

[51] Int. Cl.[7] ..... B42F 13/00

[52] U.S. Cl. ..... 402/75; 402/27; 402/28; 403/283; 24/703.6; 29/13; 29/237.5; 29/513; 29/432; 411/468

[58] Field of Search ..... 402/27, 28, 75; 403/283; 24/703.6; 29/13, 237.5, 513, 432; 411/468

[56] References Cited

U.S. PATENT DOCUMENTS 5,035,526 7/1991 Cooper et al. .

*Primary Examiner*—David P. Bryant

[57] ABSTRACT

A fastener for fastening a paper retaining binder mechanism to an inner surface of a binder while remaining entirely concealed from an outer surface of the binder. The fastener includes an anchor plate and a post. The anchor plate defines first and second major surfaces. The first major surface is in confronting relation fastened to an inner surface of the binder. The post extends directly away from the second major surface of the anchor plate and serves to secure the binder mechanism to the inner surface of the binder. Another aspect of the present invention relates to a method for fastening an apertured paper retaining binder mechanism to the binder in a manner concealing the fasteners from an outer surface of the binder.

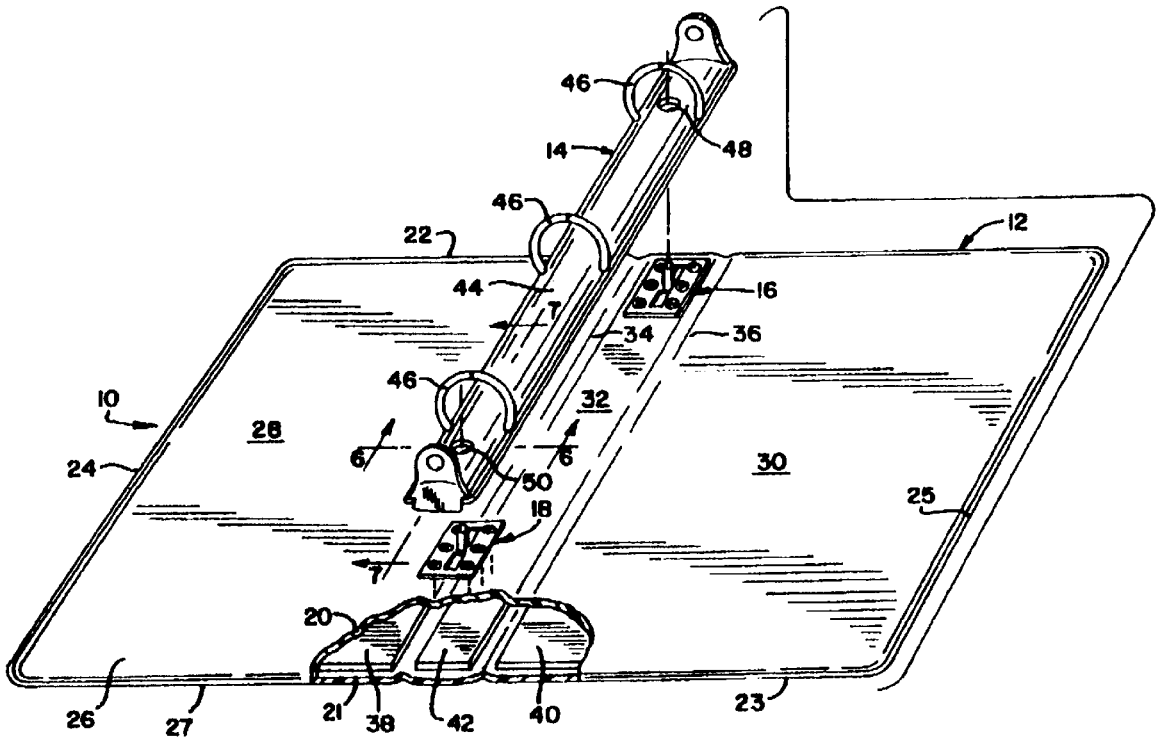

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–8 is confirmed.

Claim 10 is cancelled.

Claim 9 is determined to be patentable as amended.

New claims 11–14 are added and determined to be patentable.

9. A concealed fastener assembly for fastening paper retaining means to an inner surface of a ring binder having inner and outer surfaces, said fastener assembly comprising: a pair of fasteners attached to an inner surface of said binder for fastening said paper retaining means thereto such that said pair of fasteners are wholly concealed from an outer surface of the binder, each fastener comprising an anchor plate defining first and second major surfaces, means for securing the anchor plate to the inner surface of said binder such that a majority of the first major surface contacts and is affixed to the inner surface of the binder to prevent shifting movement therebetween and such that no portion of said anchor plate or said securing means is visible to an outer surface of the binder, and post means extending generally normal to the second major surface and secured against movement relative to said anchor plate, said post means having a generally hollow configuration which is open at a distal end and is sized to extend lengthwise through a respective aperture in said paper retaining means, with the open end of said post means having a flared configuration to locate and fasten the paper retaining means and prevent movement thereof relative to an inner surface of the binder while remaining concealed from an outer surface of the binder[.] *, wherein each post means of each fastener comprises an enlarged head portion entrapped between its respective anchor plate and the inner surface of said binder so as to remain concealed from an outer surface of said binder, the elongated hollow stem portion connected to the head portion and extending generally normal to the second major surface of the respective anchor plate, said stem portion terminating in a free end which extends through said aperture defined by said ring hardware.*

[10. The fastener assembly according to claim 9 wherein each post means of each fastener comprises a rivet-like fastener having an enlarged head portion entrapped between its respective anchor plate and the inner surface of said binder so as to remain concealed from an outer surface of said binder the elongated hollow stem portion connected to the head portion and extending generally normal to the second major surface of the respective anchor plate, said stem portion terminating in a free end which extends through said aperture defined by said ring hardware.]

*11. A concealed fastener assembly for fastening paper retaining means to an inner surface of a ring binder having inner and outer surfaces, said fastener assembly comprising a pair of fasteners attached to an inner surface of said binder for fastening said paper retaining means thereto such that said pair of fasteners are wholly concealed from an outer surface of the binder, each fastener comprising an anchor plate defining first and second major surfaces, means for securing the anchor plate to the inner surface of said binder such that a majority of the first major surface contacts and is affixed to the inner surface of the binder to prevent shifting movement therebetween and such that no portion of said anchor plate or said securing means is visible to an outer surface of the binder, and post means integrally formed with said anchor plate and extending generally normal to the second major surface and secured against movement relative to said anchor plate, said post means having a generally hollow configuration which is open at a distal end and is sized to extend lengthwise through a respective aperture in said paper retaining means, with the open end of said post means having a flared configuration to locate and fasten the paper retaining means and prevent movement thereof relative to an inner surface of the binder while remaining concealed from an outer surface of the binder.*

*12. A concealed fastener assembly for fastening paper retaining means to an inner surface of a ring binder having inner and outer surfaces, said fastener assembly comprising a pair of fasteners attached to an inner surface of said binder for fastening said paper retaining means thereto such that said pair of fasteners are wholly concealed from an outer surface of the binder, each fastener consisting of an anchor plate defining first and second major surfaces, means for securing the anchor plate to the inner surface of said binder such that a majority of the first major surface contacts and is affixed to the inner surface of the binder to prevent shifting movement therebetween and such that no portion of said anchor plate or said securing means is visible to an outer surface of the binder, and post means extending generally normal to the second major surface and secured against movement relative to said anchor plate, said post means consisting of a member having a head and a body portion, said head portion is entrapped between an underside of a central portion of said anchor plate and the inner surface of said binder and said body portion passes through an aperture in said central portion of said anchor plate, is sized to extend lengthwise through a respective aperture in said paper retaining means, and has a generally hollow configuration which is open at a distal end, said open distal end of said body portion extends directly away from said anchor plate and has a flared configuration to directly engage with an upper structure of said paper retaining means so as to locate and fasten the paper retaining means and prevent movement thereof relative to an inner surface of the binder while remaining concealed from an outer surface of the binder.*

*13. A concealed fastener assembly for fastening paper retaining means to an inner surface of a ring binder having inner and outer surfaces, said fastener assembly comprising a pair of fasteners attached to an inner surface of said binder for fastening said paper retaining means thereto such that said pair of fasteners are wholly concealed from an outer surface of the binder, each fastener consisting of an anchor plate defining first and second major surfaces, means for securing the anchor plate to the inner surface of said binder such that a majority of the first major surface contacts and is affixed to the inner surface of the binder to pevent shifting movement therebetween and such that no portion of said anchor plate or said securing means is*

*visible to an outer surface of the binder, and post means extending generally normal to the second major surface and secured against movement relative to said anchor plate, said post means having a generally hollow configuration which is open at a distal end, said open distal end of said post means extending directly away from said anchor plate and sized to extend lengthwise through a respective aperture in said paper retaining means, with the open distal end of said post means having a flared configuration to locate and fasten the paper retaining means and prevent movement thereof relative to an inner surface of the binder while remaining concealed from an outer surface of the binder, said anchor plate having a means to accommodate and hold a proximal portion of said post means relative to said anchor plate, with said proximal portion of said post means being engaged with said anchor plate closely adjacent said inner surface of said binder.*

*14. A concealed fastener assembly for fastening paper retaining means to an inner surface of a ring binder having inner and outer surfaces, said fastener assembly comprising a pair of fasteners attached to an inner surface of said binder for fastening said paper retaining means thereto such that said pair of fasteners are wholly concealed from an outer surface of the binder, each fastener comprising an anchor plate defining first and second major surfaces, means for securing the anchor plate to the inner surface of said binder such that a majority of the first major surface contacts and is affixed to the inner surface of the binder to prevent shifting movement therebetween and such that no portion of said anchor plate or said securing means is visible to an outer surface of the binder, and post means integrally formed with said anchor plate and extending generally normal to and directly away from the second major surface and secured against movement relative to said anchor plate, said post means having a generally hollow configuration which is open at a distal end and is sized to extend lengthwise through a respective aperture in said paper retaining means, with the open end of said post means having a flared configuration to directly engage with an upper structure of said paper retaining means so as to locate and fasten the paper retaining means and prevent movement thereof relative to an inner surface of the binder while remaining concealed from an outer surface of the binder.*

* * * * *